United States Patent [19]

de Calvino y Teijeiro

[11] Patent Number: 4,486,635

[45] Date of Patent: Dec. 4, 1984

[54] HIGH-VOLTAGE CIRCUIT BREAKER WITH IMPROVED PUFFER MEANS

[75] Inventor: B. J. de Calvino y Teijeiro, Monroeville, Pa.

[73] Assignee: Westinghouse Electric Corp., Pittsburgh, Pa.

[21] Appl. No.: 510,492

[22] Filed: Jul. 5, 1983

[51] Int. Cl.[3] ..... H01U 33/88

[52] U.S. Cl. ..... 200/148 A; 200/150 G

[58] Field of Search ..... 200/148 A, 150 G, 148 R

[56] References Cited

U.S. PATENT DOCUMENTS

| | | | |
|---|---|---|---|
| 3,739,124 | 6/1973 | Richter et al. | 200/148 A |
| 4,101,748 | 7/1978 | Meyer et al. | 200/148 A |
| 4,426,561 | 1/1984 | Berkebile | 200/148 A |

FOREIGN PATENT DOCUMENTS

| | | | |
|---|---|---|---|
| 2444333 | 7/1980 | France | 200/148 A |

*Primary Examiner*—Robert S. Macon

*Attorney, Agent, or Firm*—D. S. Buleza

[57] ABSTRACT

Restoration of a gas-insulated type circuit breaker having a puffer assembly to "contact-closed" condition is achieved in a positive and reliable manner by providing the puffer cylinder with one or more apertures that relieve the back-pressure created by the rapid expansion of the puffer chamber during the contact-closing stroke of the arc-interrupter unit. The pressure-relieving aperture or apertures are so shaped and located that they are automatically opened and closed at the proper times by the movement of the puffer cylinder and movable contact relative to the stationary piston component. The gas-compression and puffer functions during the contact-opening operation and subsequent relief of the back-pressure condition during the contact-closing operation of the circuit breaker are thus provided without the need of check valves heretofore employed in the piston head to control the flow of the insulating gas into and out of the puffer chamber when the breaker is actuated through a full cycle of operations.

10 Claims, 9 Drawing Figures

HIGH-VOLTAGE CIRCUIT BREAKER WITH IMPROVED PUFFER MEANS

BACKGROUND OF THE INVENTION

This invention relates generally to circuit interrupting apparatus and, more particularly, to a high-voltage gas-insulated circuit breaker having an improved puffer assembly.

High-voltage power circuit breakers which employ a movable contact and a stationary piston arrangement to provide a puffer assembly that directs a blast of compressed insulating gas into the arc and quickly extinguishes it are well known in the art. A modular puffer-type circuit interrupter which operates in this fashion is disclosed in U.S. Pat. No. 4,101,748, issued Jul. 18, 1978 to J. R. Meyer et al. One of the problems associated with the operation of such puffer assemblies is their inherent characteristic of developing back-pressure during the contact-closing operation of the interrupter. Such back-pressure is produced by the partial vacuum or "negative pressure" created within the puffer chamber when the puffer cylinder moves away from the stationary piston, along with the movable contact, when the latter is returned to its contact-closed position and the insulating gas is unable to flow into and fill the expanding piston chamber quickly enough. The resulting back-pressure is undesirable since it retards the contact-closing operation and puts additional mechanical stress on the linkage system and operating mechanism.

In the prior art circuit breakers, this back-pressure problem was solved by providing check valves in the piston head of the puffer assembly which permitted an in-flow of insulating gas into the puffer chamber during the closing stroke of the interrupter but closed off the chamber during the opening stroke and thus did not interfere with the compression of the gas within the chamber and the resulting arc-extinguishing puffer action when the contacts were being opened. While such check valves were generally satisfactory from a functional standpoint, they complicated the assembly of the circuit interrupters and increased their manufacturing cost. It is also very difficult and expensive to replace malfunctioning or inoperative check valves in the field since the contact and puffer assemblies are in a sealed tank and are thus not readily accessible.

SUMMARY OF THE INVENTION

In accordance with the present invention, the back-pressure problem associated with the contact-closing operation of such circuit breakers is eliminated by providing one or more apertures in the movable cylinder of the puffer assembly at a strategically located position such that the aperture or apertures are only open during the start of the contact-opening stroke of the interrupter and at the very end of the contact-closing stroke. The pressure-relief apertures are thus open when the back-pressure would be greatest and are closed during the major portion of the contact-opening stroke of the interrupter when the insulating gas is being compressed within the puffer chamber and then blasted into the arc formed between the parting contacts. The pressure-relief aperture or apertures of the present invention accordingly provide a simple, reliable and inexpensive solution to the back-pressure problem without the use of check valves or similar components.

While the configuration of the pressure-relief aperture or apertures is not critical, it should be such that the total "size" of the opening provided in the puffer assembly is sufficient to relieve the back-pressure at the proper time without materially reducing the gas-compressing and puffer actions of the interrupter.

BRIEF DESCRIPTION OF THE DRAWINGS

A better understanding of the invention will be obtained from the exemplary embodiments illustrated in the accompanying drawings wherein.

DESCRIPTION OF THE PREFERRED EMBODIMENTS

While the invention can be used in various kinds of circuit interrupters that employ puffer assemblies which automatically direct a flow of compressed insulating gas into the arc between the parting electrodes and function in a manner which inherently creates a back-pressure condition during the contact-closing operation, it has been embodied in a dead-tank modular type circuit breaker that contains a single interrupter unit and has accordingly been so illustrated and will be so described.

Figure 1:
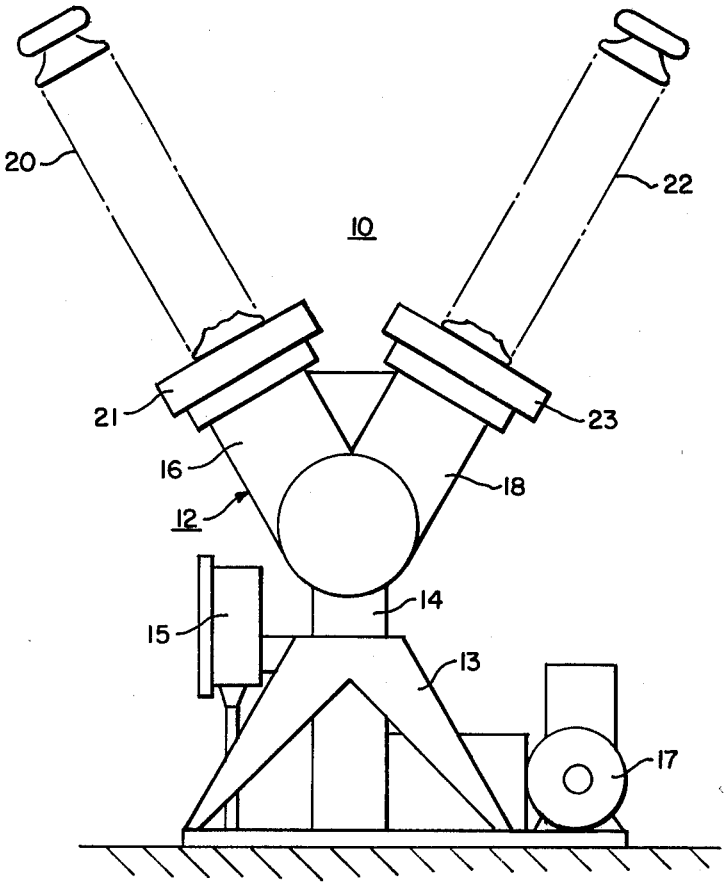
FIG. 1 is a front elevational view of a puffer type high-voltage circuit breaker which embodies the present invention and has a modular Y-shaped tank that contains a single interrupter unit.

A typical high-voltage puffer type circuit breaker 10 which incorporates the improved puffer assembly of the present invention is shown in FIG. 1. As will be noted, the circuit breaker 10 comprises a modular Y-shaped tank 12 that is formed from metallic tubular casing elements that have been suitably cut and joined together to form a unitary housing having a base leg 14 that merges with two upstanding and diverging arm portions 16, 18 which are fitted with a pair of protruding terminal bushings 20, 22 of suitable insulating material such as porcelain or the like. As is customary, current-transformer structures 21, 23 are coupled to the terminal bushings 20, 22 to measure the amperage of the line current passing through the circuit interrupter 10 and detect any faults or other problems that could produce destructive surges of line current. The Y-shaped tank 12 provides a gas-tight housing which is filled with a suitable insulating gas (such as sulfur hexafluoride gas) and is supported by a frame 13 and a suitable rigid platform means which also supports the control cabinet 15 and compressed air reservoir 17 for operating the circuit breaker 10.

Figure 2:
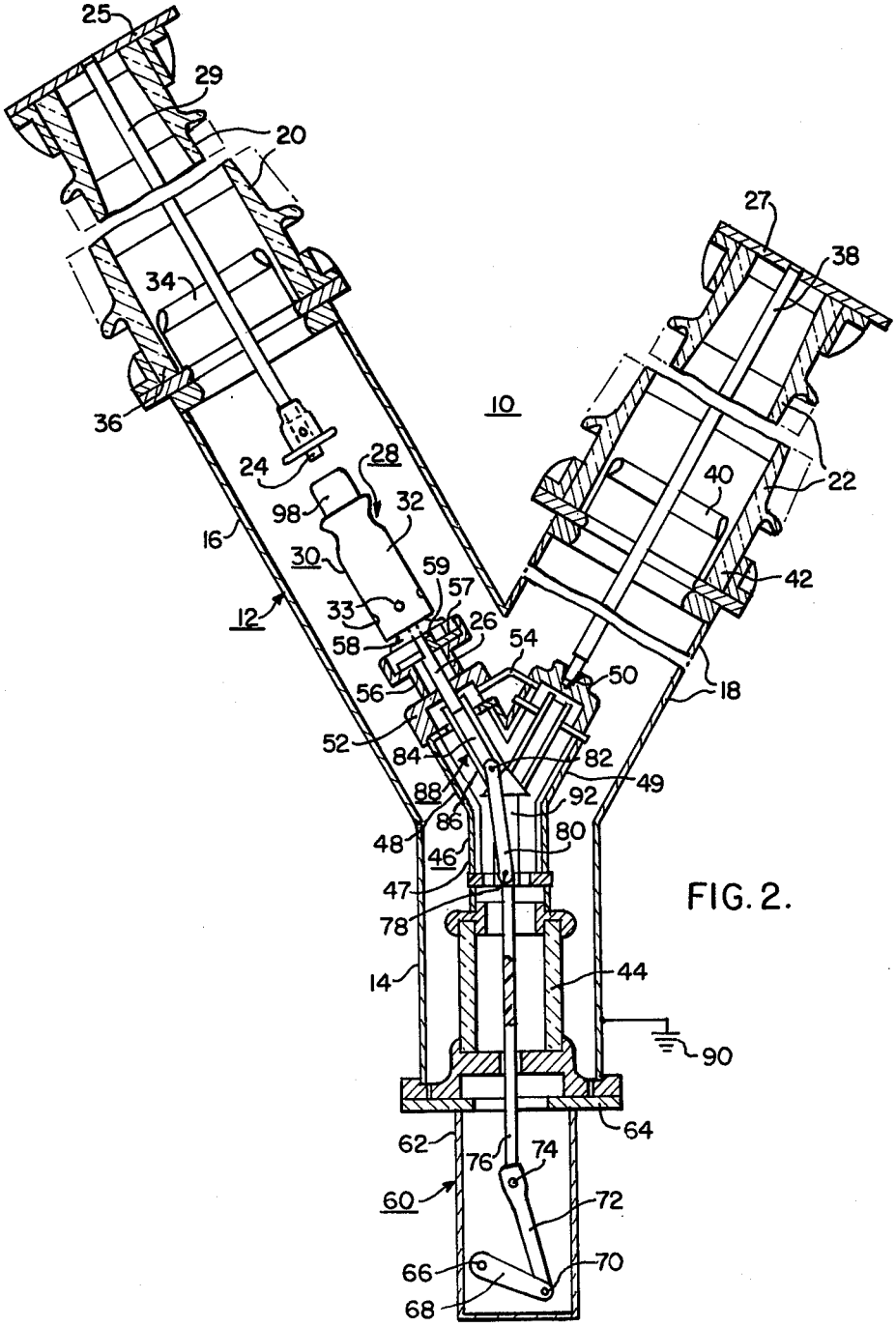
FIG. 2 is an enlarged cross-sectional view of the top portion of the circuit breaker of FIG. 1 illustrating the internal structure with the interrupting unit in its open-circuit position.

As illustrated in FIG. 2, disposed within either or both of the hollow upstanding arm portions 16, 18 of the breaker tank 12, (depending upon the voltage rating of the interrupter apparatus) is an arc-extinguishing circuit-interrupter unit 28 of the compressed gas puffer type. The puffer assembly 30 is shown in greater detail in FIGS. 3A-3C and its operation is hereinafter described in corresponding detail. In this particular embodiment, the circuit breaker 10 is designed for use at a rating in the 121 kilovolt through 169 kilovolt range and thus contains a single interrupter unit 28.

As shown in FIG. 2, the interrupter unit 28 is disposed within arm portion 16 of the circuit-breaker tank 12 and consists of a stationary contact 24 and a movable contact 26 that form part of a puffer assembly 30 which is coupled to a suitable actuating linkage and operting mechanism. The terminal bushing 20 which is secured to arm portion 16 of the tank 12 has a cover 25 which closes off the bushing and prevents the escape of the insulating gas which fills the tank. The other terminal bushing 22 which is joined to the other arm portion 18 of the tank 12 is also fitted with a closing cover 27. Covers 25, 27 serve the additional function of incoming and outgoing terminals for the circuit breaker 10.

Disposed within the bushing 20 is a bushing conductor 29 which is electrically connected to the first terminal 25 that would be connected, for example, to an incoming power line (not shown). The bushing conductor 29 is also connected to the stationary contact 24 which is located within the upstanding arm portion 16 of the circuit breaker 10. The stationary contact 24 cooperates with a movable contact 26 which is secured to the movable cylinder 32 of the puffer assembly 30. In accordance with this embodiment of the present invention, the puffer cylinder 32 is provided with four circumferentially-spaced apertures 33 which relieve the back-pressure produced by the puffer cylinder 32 and piston 58 during the contact-closing stroke of the circuit breaker 10. Also located within the bushing 20 is a bushing shield 34 which controls the electric field gradients at the end 36 of the bushing 20 where it is connected to the tank arm 16.

Another bushing conductor 38 is disposed in the other bushing 22 and electrically connected to the end cover 27 which thus serves as the second line terminal that is connected to the outgoing electrical power line (not shown). As before, an electrical shield 40 is located within the bushing 22 to control the electrical gradients at the base 42 of the bushing 22 where it is secured to the metal arm 18 of the circuit breaker tank 12.

As is further illustrated in FIG. 2, an insulating support 44 is mounted within the base leg 14 of the tank 12 and secured to a Y-shaped contact support member 46 which has a base portion 47 and a pair of angled arms 48, 49 that are aligned with the base leg 14 and diverging arm segments 16, 18 of the Y-shaped tank 12, respectively. The contact support arm 49 has a contact structure 50 at its outermost end which mates with the bushing conductor 38 to provide electrical contact and continuity therewith. The contact support arm 48 is secured to a transfer support member 52 that is electrically connected to the contact structure 50 by means of a shunt element 54. The transfer support member 52 supports the interrupter support 56 which is aligned with the tank arm 16 and supports another contact structure 57. Contact structure 57 physically supports the stationary puffer piston 58 within the tank arm 16 and further provides electrical continuity, through contacts 59, between the movable contact 26 and interrupter support 56. Thus, the electrical path through the interrupter 28 is complete, when the contacts 24, 26 are in closed position, from the incoming power line (not shown) through the terminal 25, bushing conductor 29, stationary contact 24, movable contact 26, contacts 59 and then through the contact structure 57 to interrupter support 56, transfer support member 52, shunt 54, the other contact structure 50 and through bushing conductor 38 to the other terminal 27.

As will be noted in FIG. 2, associated with base leg 14 of the tank 12 is an operating mechanism 60 which actuates the interrupter unit 28. This operating mechanism 60, although illustrated in FIG. 2 as being contained within a housing 62 which is secured to a bottom flange 64 which caps the base leg 14, may instead be included within the base leg 14 if the latter is constructed to be longer than illustrated. The operating mechanism 60 consists of a drive shaft 66 which extends through the housing 62 to the exterior of the circuit breaker 10 and is connected either to a manual handle (not shown) or to a pneumatic operating apparatus (not shown) of the type illustrated in U.S. Pat. No. 4,110,578 issued Aug. 29, 1978 to Freeman et al. The drive shaft 66 is fixedly connected to a drive lever 68 which, in turn, is pivotally connected by a pin 70 to a link 72. The link 72 is pivotally connected by pin 74 to an insulating drive rod 76 which extends into the base leg 14 of the tank 12 and into the contact support base section 47. The insulating drive rod 76 is, in turn, pivotally connected by a pin 78 to a connecting link 80 which is also pivotally connected at 82 to an operating rod 84. The operating rod 84 is fixedly connected to the movable contact 26 and the operating rod is reciprocally movable within a guide 86 which is supported by the contact support 52. The operating mechanism 60 is thus capable of reciprocally moving and actuating the movable contact 26 by means of the drive rod means 88 which comprises the operating rod 84, link 80, and the drive rod 76.

As will be noted, the Y-shaped tank 12 is grounded by suitable means 90 so that the circuit breaker 10 is of the "dead tank" design.

Figure 3A:
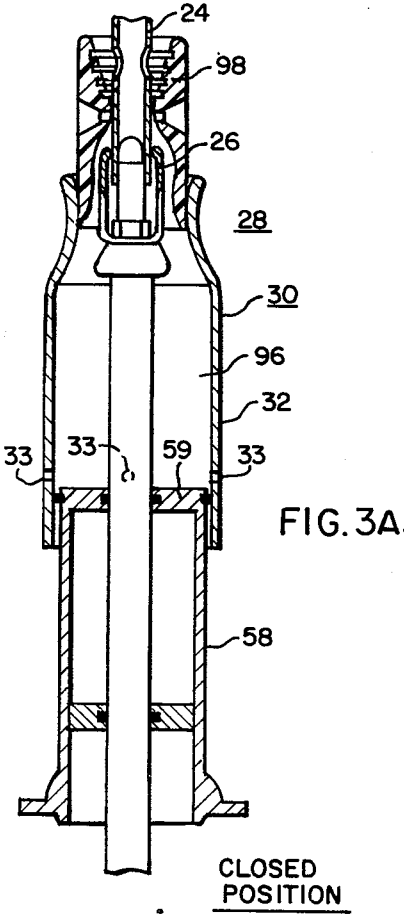
FIGS. 3A–3C are enlarged cross-sectional views of the puffer and contact assembly of the arc-interrupting unit of the circuit breaker showing the contact elements in closed-circuit, arcing, and open-circuit positions, respectively.

The operating of the interrupter unit 28 and improved puffer assembly 30 of the circuit breaker 10 can best be understood with reference sequentially to FIGS. 2 and 3A-3C. In FIG. 3A, the movable contact 26 is in locked interfitting contacting relationship with the stationary contact 24 and the circuit breaker 10 is accordingly in its "closed" position. When the breaker is actuated by the operating mechanism and linkage system shown in FIG. 2, the drive shaft 66 rotates in a clockwise direction, thereby producing a corresponding clockwise rotation of the lever 68. Rotating lever 68 produces downward movement of the link 72 which affects a corresponding downward movement of the drive rod 76 as it rides within its drive rod guide 92. The downward movement of drive rod 76 pulls link 80 downwardly which, in turn, pulls operating rod 84 downwardly within its guide 86. Such movement of operating rod 84 pulls the movable contact 26 downwardly (as indicated by the solid arrow in FIG. 3B) causing it to separate from the stationary contact 24 and initiating an arc 94 between the parting contacts. Downward movement of the movable contact 26 effects a similar downward movement of the puffer cylinder 32 which is secured to the movable contact 26, thus causing the puffer cylinder 32 to move over the stationary piston 58 and compress the insulating gas which is trapped in the chamber 96 defined by the clinder and the piston. As the contacts 24, 26 continue separating and the puffer cylinder continues to move down over the piston 58, the pressure of the compressed gas in the puffer chamber 96 increases and the resulting blast of gas is directed in an axial direction into the arc stream by an insulating nozzle 98 which is secured to and moves with the puffer cylinder 32. This blast of compressed insulating gas sweeps away the hot arc gases and stretches and cools the arc 94 which is thus rapidly extinguished, thereby interrupting the current flow in the circuit.

Figure 3B:
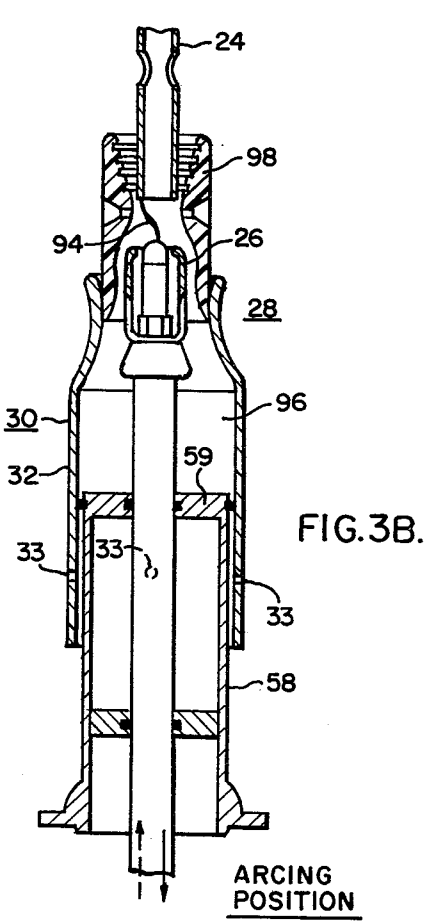
Figure 3C:
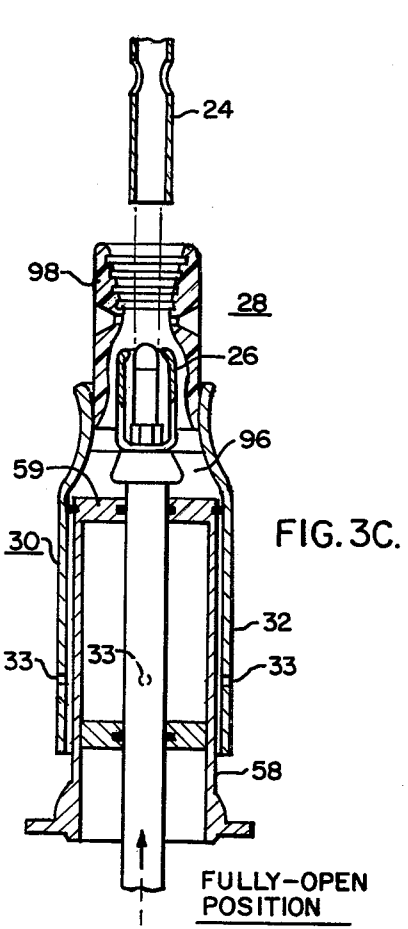

As shown in FIG. 3C, at the end of the downward stroke applied to the movable electrode 26 and puffer assembly 30 by the operating mechanism 60, the contacts 24, 26 are completely separated and the circuit breaker 10 is in its fully-opened position so that the flow of electric current between the breaker terminals 25, 27 is interrupted.

After the fault (or other cause of the current overload) which tripped the circuit breaker 10 has been cleared, the operating mechanism 60 is again actuated and the above-described sequence of operative steps is reversed, thus rapidly pushing the movable contact 26 and puffer cylinder 32 toward the stationary contact 24, as indicated by the broken arrows in FIGS. 3B and 3C, until the contacts are again mated with one another and the circuit breaker 10 is returned to its "closed" position and reestablishes circuit continuity.

In accordance with the present invention, the back pressure in the puffer assembly 30 created by the rapid return movement of the puffer cylinder 32 away from the stationary piston 58 during the contact-closing stroke of the circuit breaker 10 is automatically relieved by providing a series of four apertures 33 in the puffer cylinder 32 at a predetermined location adjacent its free end. As will be noted in FIG. 3A, the pressure-relief apertures 33 are located so that they clear the head 59 of the piston 58 at the very end of the contact-closing operation of the breaker 10 when the partial vacuum and "negative pressure" within the puffer chamber 96 are at their peak. As this point in time, the insulating gas in the region surrounding the puffer assembly 30 flows through the apertures 33 into the chamber 96 and rapidly relieves the back pressure so that the contacts 24, 26 are firmly engaged with one another and the breaker 10 is restored to its "closed" position in a very positive and reliable manner. In contrast to the prior art breakers, the piston head 59 is of solid construction and devoid of check valves which heretofore were required to control the flow of insulating gas into the puffer chamber 96 and avoid the back-pressure problem.

Figure 4:
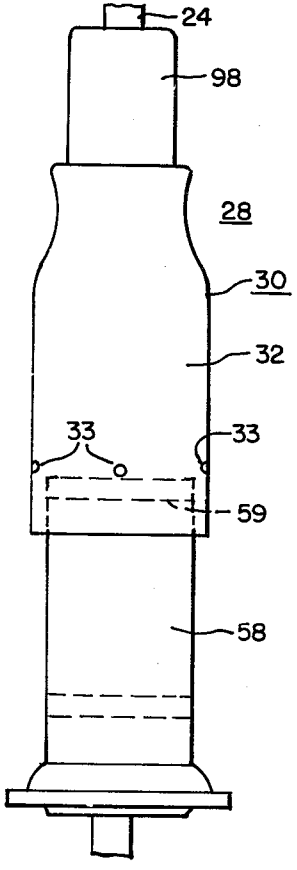
FIG. 4 is an elevational view of the puffer and contact assembly in full outline showing the location of the pressure-relief apertures when the assembly is in its closed-circuit position; and, FIGS. 5–7 are similar elevational views of alternative puffer assembly embodiments which employ pressure-relief apertures of different shapes and arrangements.

As will be noted in FIG. 3A and more particularly in FIG. 4, in this particular embodiment the pressure-relief apertures 33 are circular in shape and circumferentially spaced approximately 90° from each other and also located a short but predetermined distance beyond the piston head 59 when the circuit breaker 10 is in closed position. It is important that the apertures 33 be of the proper size and located in the proper position relative to the piston head 59 when the puffer assembly 30 is at the end of its upward traved and the contacts 24, 26 are in fully mated and closed relationship. If the apertures 33 are too large or are located too close to the nozzle end of the puffer cylinder 32, an excessive amount of the insulating gas in the puffer chamber 96 would escape during the contact-opening operation and the gas-compressing ability of the puffer assembly 30 would be greatly reduced. This, in turn, would reduce the velocity with which the compressed gas is blasted into the arc and could change the operating characteristics of the circuit breaker 10 and the speed with which it is able to extinguish the arc and interrupt the current flow. In this particular embodiment, the diameter of each of the pressure-relief apertures 33 was approximately 1/12 the diameter of the puffer cylinder 32 and (in terms of the puffer cylinder diameter D) each of the apertures were spaced from the tip of the insulating nozzle 98 an axial distance that was approximately equal to 2.6 D.

As shown in FIG. 3D, the pressure-relief apertures 33 are obstructed and closed by the piston 58 during practically the entire length of the contact-opening stroke of the interrupter unit 28 and thus do not interfere with the gas-compressing action of the piston 50 and puffer cylinder 32 during this crucial phase of breaker operation. As will be noted in FIG. 3C, the pressure-relief apertures 33 are located adjacent the outer end of the piston 58 when the circuit breaker 10 is in its "fully-open" position and thus remain blocked by the piston until the very end of the contact-closing operation when the upward movement of the puffer cylinder 32 is sufficient to place the apertures beyond the piston head 59---thereby automatically opening the apertures 33 and permitting them to function as relief gas-passageways between the interior and exterior of the puffer assembly 30 during the last portion of the contact-closing stroke.

Figure 5:
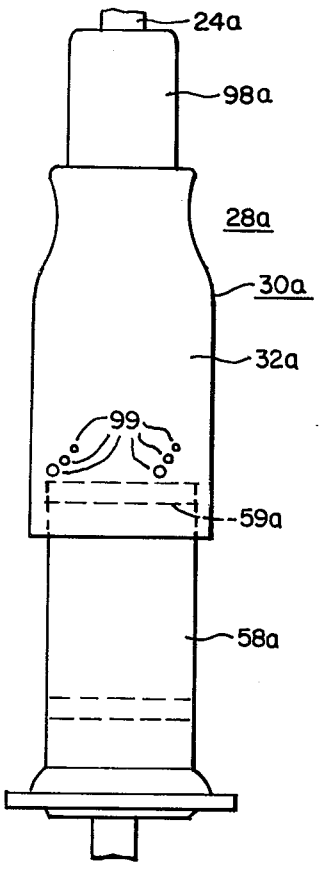

Neither the shape nor spatial arrangement of the pressure-relief apertures are cirtical and variations in these characteristics can accordingly be made without departing from the spirit and scope of the invention. For example, in the alternative interrupter unit **28*a* and puffer assembly 30*a* shown in FIG. 5, the pressure relief apertures consist of a series of circular holes 99 that are grouped in rows of three adjacent the lower end of the puffer cylinder 32*a* along lines that are parallel to one another but skewed relative to the longitudinal axis of the puffer assembly. The holes 99 are progressively smaller in diameter with the largest diameter hole being located just beyond the piston head 59*a* when the puffer assembly 30*a*** is in its contact-closed position shown in FIG. 5.

Figure 6:
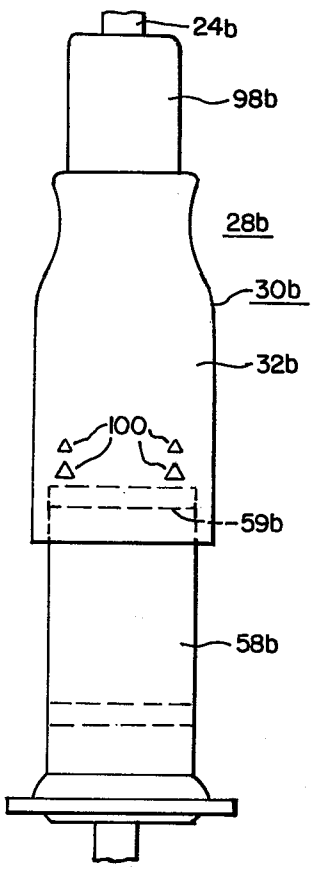

In the alternative interrupter unit **30*b* and puffer assembly 30*b* shown in FIG. 6, triangular shaped pressure-relief apertures 100 are employed and arranged vertically in pairs of different size with the larger aperture located closer to the piston head 59*b* and lower end of the puffer cylinder 32*b*. In contrast to the previous embodiment, the triangular shaped apertures 100 are spaced from one another in groups which are arranged to extend generally parallel to the longitudinal axis of the puffer assembly 30*b***.

Figure 7:
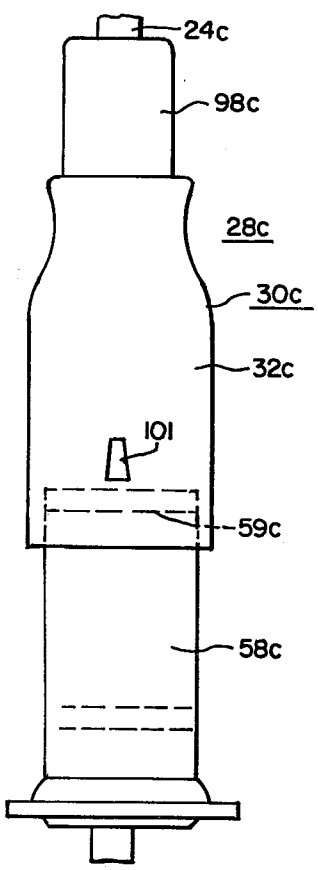

The desired controlled relief of the back pressure during the contact-closing operation can also be obtained in accordance with the invention by using a single slot-like aperture 101 at the proper location on the end of the puffer cylinder **32*c* (as in the alternative puffer assembly 30*c* shown in FIG. 7). As will be noted, the aperture 101 is of tapered configuration and extends in an axial direction along the puffer cylinder 32*c* with its widest dimension located just above the piston head 59*c* when the puffer assembly 30*c* and interrupter unit 28*c* are in their contact-closed positions. This tapered configuration provides the rapid relief of the back pressure during the closing stroke of the circuit breaker but minimizes the reduction in gas compression during the contact-opening stroke insofar as the largest part of the aperture 101 is obstructed and blocked by the piston 58*c* at the very beginning of the downward movement of the puffer cylinder 32c** and is opened at the very end of the upward movement of the cylinder.

I claim:

1. In combination with a gas-insulated type circuit interrupter that has a sealed housing which contains an insulating gas, an arc-extinguishing unit that includes a stationary contact and an elongated movable contact, and operating means which actuates the arc-extinguishing unit and places the contacts in closed-circuit and open-circuit relationships, a puffer assembly comprising;

a hollow piston component disposed in fixed spaced-apart position relative to said stationary contact and enclosing a portion of said elongated movable contact, said piston component having head means which supportingly accommodates the enclosed portion of said elongated movable contact, and a puffer cylinder secured to and movable with the movable contact and structured and disposed to move over and along the stationary piston component when the movable contact is actuated, said puffer cylinder and piston component defining a puffer chamber for compressing insulating gas, during the displacement of the movable contact from its contact-closed position, and then directing the compressed gas into the arc bridging the parting contacts, said puffer cylinder having integral means for relieving the back-pressure produced by the sudden expansion of the puffer chamber during the return of the movable electrode and puffer cylinder to their contact-closed positions, said pressure-relief means comprising at least one aperture in the puffer cylinder which is so oriented that the aperture is obstructed and closed by the stationary piston during the major portion of the gas-compressing movement of the cylinder but is located beyond the piston and is thus automatically opened during the chamber-expansion movement of the cylinder.

2. The combination set forth in claim 1 wherein said pressure-relief aperture in the puffer cylinder is located adjacent to and a predetermined distance beyond the piston head means when the movable electrode and puffer cylinder are in their contact-closed positions.

3. The combination set forth in claim 1 wherein said piston and the head means thereof are devoid of valve means for relieving the back-pressure condition and the apertured puffer cylinder thereby constitutes the sole means for relieving such back-pressure.

4. The combination set forth in claim 3 wherein said back-pressure relief means comprises a plurality of apertures in the puffer cylinder disposed at spaced intervals around the circumference thereof.

5. The combination set forth in claim 4 wherein said apertures are of circular shape and spaced 90° apart around the circumference of the puffer cylinder.

6. The combination set forth in claim 3 wherein the back-pressure relief means comprises a series of apertures in the puffer cylinder that are arranged in circumferentially-spaced groups with the apertures in each group being of progressively smaller size and aligned with one another in predetermined relationship with the longitudinal axis of the puffer cylinder.

7. The combination set forth in claim 6 wherein said apertures are of circular configuration and arranged in groups of three that are substantially disposed in parallel-spaced relationship with one another but in skewed relationship with respect to the longitudinal axis of the puffer cylinder.

8. The combination set forth in claim 6 wherein said apertures are of triangular configuration and arranged in pairs in substantially parallel relationship with the longitudinal axis of the puffer cylinder, the apertures in each pair being of different size.

9. The combination set forth in claim 3 wherein said back-pressure relief means comprises a single aperture of tapered slot-like configuration in the puffer cylinder, said tapered aperture extending in a generally axial direction along the cylinder with the widest dimension thereof located adjacent the piston head means when the cylinder is in contact-closed position.

10. The combination set forth in claim 5 wherein;

the end of the movable puffer cylinder adjacent the stationary contact is terminated by a nozzle component that directs the compressed insulating gas into the arc produced when the movable contact is actuated and separated from the stationary contact, the circular pressure-relief apertures each have a diameter that is approximately 1/12 the diameter of the puffer cylinder, and each of said apertures are also spaced from the tip of said gas-directing nozzle component an axial distance that is approximately equal to 2.6 times the diameter of the puffer cylinder.

* * * * *